US007086559B2

(12) United States Patent
Poole, Jr.

(10) Patent No.: US 7,086,559 B2
(45) Date of Patent: Aug. 8, 2006

(54) BUSINESS CARD HOLDER AND DISPENSER

(76) Inventor: Larry S. Poole, Jr., 10309 Janice Pl., Waldorf, MD (US) 20601

( * ) Notice: Subject to any disclaimer, the term of this patent is extended or adjusted under 35 U.S.C. 154(b) by 263 days.

(21) Appl. No.: 10/698,428

(22) Filed: Nov. 3, 2003

(65) Prior Publication Data

US 2005/0092768 A1 May 5, 2005

(51) Int. Cl.
*A47K 10/24* (2006.01)
*B65H 1/00* (2006.01)

(52) U.S. Cl. ..... 221/46; 221/45; 221/283; 206/818

(58) Field of Classification Search ..... 221/232, 221/33, 45, 46, 282, 283; 206/449, 818, 206/233, 39; 224/482, 441
See application file for complete search history.

(56) References Cited

U.S. PATENT DOCUMENTS 3,261,126 A * 7/1966 Marks ..... 47/41.12
3,463,309 A * 8/1969 Szostek ..... 206/470
D289,122 S 4/1987 Meyer et al.
D314,488 S 2/1991 Aaldenberg et al.
5,183,153 A * 2/1993 Linn ..... 206/232
5,272,826 A 12/1993 Gingras
5,595,300 A * 1/1997 Paik et al. ..... 206/449
5,645,203 A * 7/1997 Tappenden ..... 224/482
D391,990 S * 3/1998 Wolff ..... D19/78
5,850,957 A 12/1998 Morris
5,947,304 A * 9/1999 Thorp ..... 211/69.5

FOREIGN PATENT DOCUMENTS

GB 2 234 383 A 1/1991

* cited by examiner

*Primary Examiner*—Douglas A. Hess
(74) *Attorney, Agent, or Firm*—Richard C. Litman

(57) ABSTRACT

A disposable dispensing business card holder, made of molded or folded clear, thin plastic forming a front pocket of an open-topped card holder and dispenser, the front rim of which has a cutout for grasping a single card while leaving the remainder of the cards in the dispenser. The card holder is made to hold about 25 cards for dispensing and may have an adhesive backing on the flat backing portion for attachment to a surface. The flat backing portion may also be easily attached to bulletin boards by pins, staples, tacks, or thumbtacks. Alternately, the card holder may have a magnetic backing attached for attachment to metal signs or doors. In addition, the flat backing portion of the holder may have a double wall for receiving a card, viewable by prospective customers once all the cards have been taken from the dispensing portion of the holder.

11 Claims, 8 Drawing Sheets

BUSINESS CARD HOLDER AND DISPENSER

BACKGROUND OF THE INVENTION

1. Field of the Invention

The present invention relates to holders for dispensing. More particularly, the present invention relates to holders for dispensing business cards.

2. Description of the Related Art

The use of business cards is widespread, many of which are provided personally to a prospective customer. Also, it is common to provide brochures for distribution to customers having a holder for a single business card holder that the customer may remove for future reference while the brochure is separately filed or destroyed. In some circumstances, however, the business person or employee may want to make business cards available to the public while the business person or employee is unavailable, such as when at lunch or out on a business call. It would be desirable to provide a business card holder specifically designed for holding and dispensing of a number of business cards which may be located at a desired location such as the place of business or at a trade show, and to make the cards available while the business person or employee is away from the place of business or trade show booth such as for lunch or for other exigencies. It is also desirable to provide such a holder in combination with permanent in-place advertising such as a brochure or sign permanently affixed at the location of business. It is also desirable that such a holder be disposable such that minimal cost is involved in disposal of the item carrying the card holder such as a brochure.

It is also desirable to provide such a holder for displaying and providing business cards or the like where commonly only a single card is posted such as community bulletin boards found in grocery stores, convenience stores, book stores, and the waiting areas of various service businesses such as car repair shops and barber shops. With thin or film-like plastic construction, the inventive card holder would allow posting on such bulletin boards by means of thumb tacks or pins, and the inexpensive nature of the inventive card holder would allow for posting of the card holder on such boards without regard to recovery of the card holder.

U.S. Pat. No. Des. 289,122, issued Apr. 7, 1987 to Meyer et al., depicts a magnetic wall-mounted receptacle having a cutout at the front lip thereof.

U.S. Pat. No. Des. 314,488, issued Feb. 12, 1991, to Aaldenberg, et al, depicts a wall-mounted receptacle having a cutout at the front lip thereof.

U.S. Pat. No. 5,272,826, issued Dec. 28, 1993, to Gingras, describes a display card holder having a magnetic part for affixing the holder to the underside of a metal shelf.

U.S. Pat. No. 5,850,957, issued Dec. 22, 1998, to Morris, describes a business card holder and dispenser having an adhesive backing for attachment to a vehicle window. The Morris dispenser is apparently of substantial structure so as to withstand wind forces during driving of the vehicle and thus would not be readily disposed of due to the cost of manufacture.

British Patent 2,234,383 A, describes a display cabinet for displaying and dispensing business cards as see, particularly FIG. 3 where a drawer having a lip cutout is shown. The British Patent is clearly not intended to be a disposable item.

None of the above inventions and patents, taken either singly or in combination, is seen to describe the instant invention as claimed. Thus, a business card holder solving the aforementioned problems is desired.

SUMMARY OF THE INVENTION

The present invention is a dispensing business card holder which is inexpensive to make and is thus disposable. The card holder is preferably made of molded or folded clear, relative thin or film-like plastic. The card holder forms a front, open-topped card holder and dispenser, the front rim of which has a cutout to allow the customer to easily grasp a single card by friction with the thumb or the like with the front card, while leaving the remainder of the cards remain in the dispenser. The card holder is preferably made to hold about 25 cards for dispensing, however, the card holder may be made to hold more or fewer cards as desired.

The card holder preferably has a flat backing portion which is larger in dimensions than the card holding portion, particularly at the sides and bottom of the holder as mounted on a vertical surface. The inventive card holder and dispenser may have an adhesive backing on the flat backing portion, the adhesive backing having a peel-off layer to avoid adherence of the backing to surfaces or the user before attachment to the desired surface. The flat backing portion may also be easily attached by pins, staples, or tacks such as thumbtacks to the desired surface due to the thin nature of the plastic construction.

The inventive card holder is sized for displaying and providing business cards or the like where commonly only a single card is posted, such as community bulletin boards found in grocery stores, convenience stores, book stores, and the waiting areas of various service businesses such as car repair shops and barber shops. The thin or film-like plastic construction of the inventive card holder allows posting on such bulletin boards by means of thumb tacks or pins, and the inexpensive nature of the inventive card holder allows for posting of the card holder on such boards without regard to recovery of the card holder. Such a card holder may be revisited at a later date and replenished with a supply of business cards, or, if removed by the proprietor as is done periodically, a new card holder may be posted having a supply of cards available to the public.

The inventive card holder may also be provided with a magnetic backing attached to the flat backing portion by heat sealing or other means, providing a card holder and dispenser for attachment to metal signs or doors. The flat backing portion of the holder may have a double wall for receiving a card which is viewable by prospective customers, once all the cards have been taken from the dispensing portion of the holder. The double wall back portion is so arranged that the card held therein is not easily removed and may be permanently attached therein by adhesive or heat-sealing. A card of magnetic material may, alternatively, be placed in the double-wall back portion, making the holder and dispenser capable of being mounted on a metal surface.

Accordingly, it is a principal object of the invention to provide a business card holder and dispenser to be located to make business cards available when the business person or employee is absent and which is simple in design and light in construction such that it is disposable.

It is another object of the invention to provide a business card holder and dispenser as above having a backing portion which may be attached to a vertical surface by pins, tacks, staples, adhesive, or magnetic force.

It is a further object of the invention to provide a business card holder and dispenser having a front holding portion having a front rim cutout for ease in dispensing a single business card to a customer.

Still another object of the invention is to provide a business card holder having a double wall back portion for permanently holding a business card viewable by prospective customers once all cards in the holding and dispensing portion is exhausted of business cards.

Yet another object of the invention is to provide a business card holder and dispenser as above which is of such a size as to allow its posting by pins or thumbtacks in locations where single business cards are typically posted such a community bulletin boards.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention a dispensing business card holder and dispenser which is inexpensive to make and is thus disposable. The card holder is preferably made of molded or folded clear, relative thin or film-like plastic. The card holder forms a front, open-topped card holder and dispenser, the front rim of which has a cutout to allow the customer to easily grasp a single card by friction with the thumb or the like with the front card, while leaving the remainder of the cards remain in the dispenser. The card holder is preferably made to hold about 25 cards for dispensing, however, the card holder may be made to hold more or fewer cards as desired.

Figure 1:
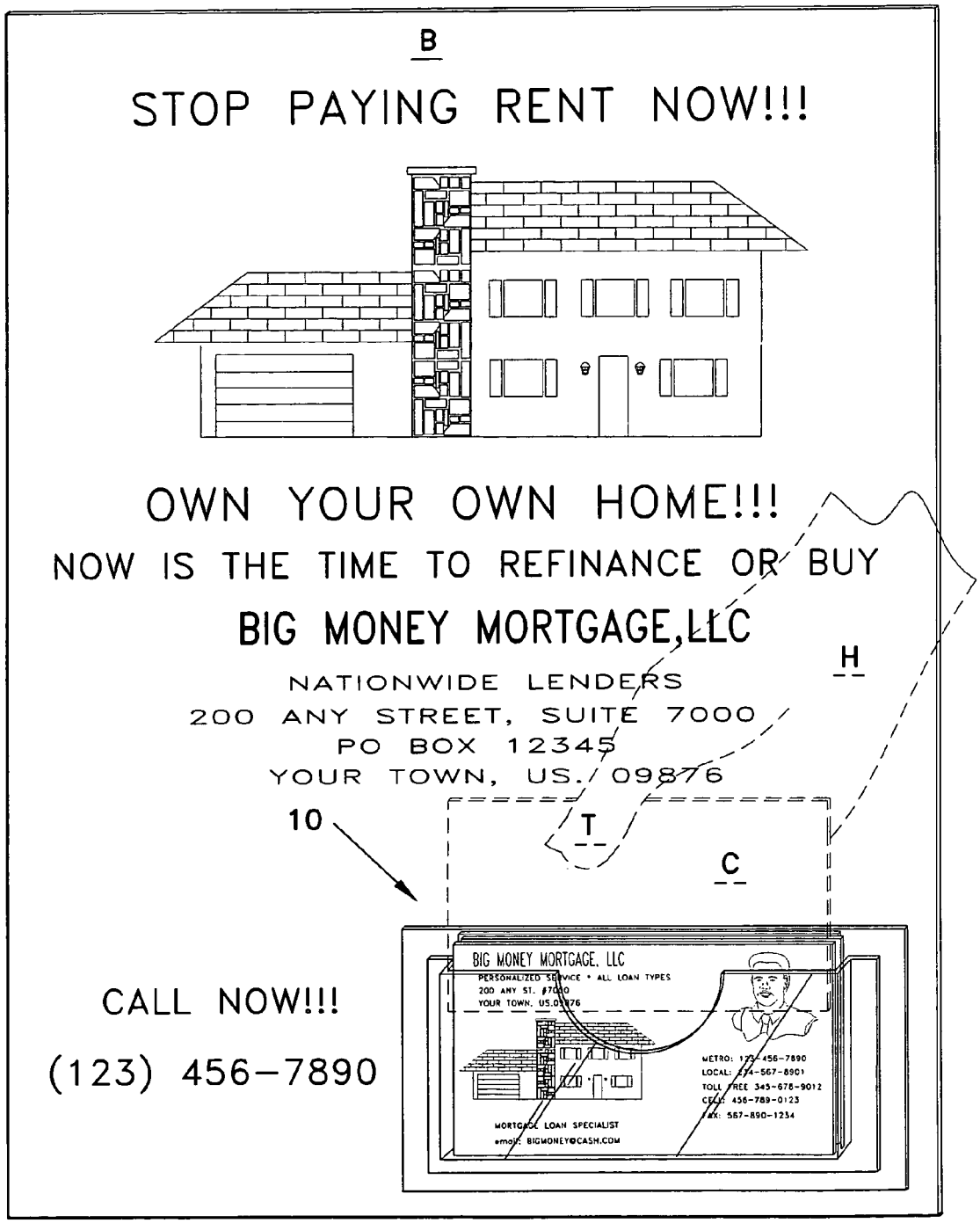
FIG. 1 is an environmental, perspective view of a business card holder according to the present invention as mounted on a brochure.

Referring to the Figures, the card holder and dispenser of the present invention, generally designated by the reference number 10, holds a plurality of business cards C. As best seen in FIG. 1, card holder and dispenser 10 may be mounted at a convenient location on a brochure or sign B for easy removal by a customer's hand H using thumb T.

Figure 2:
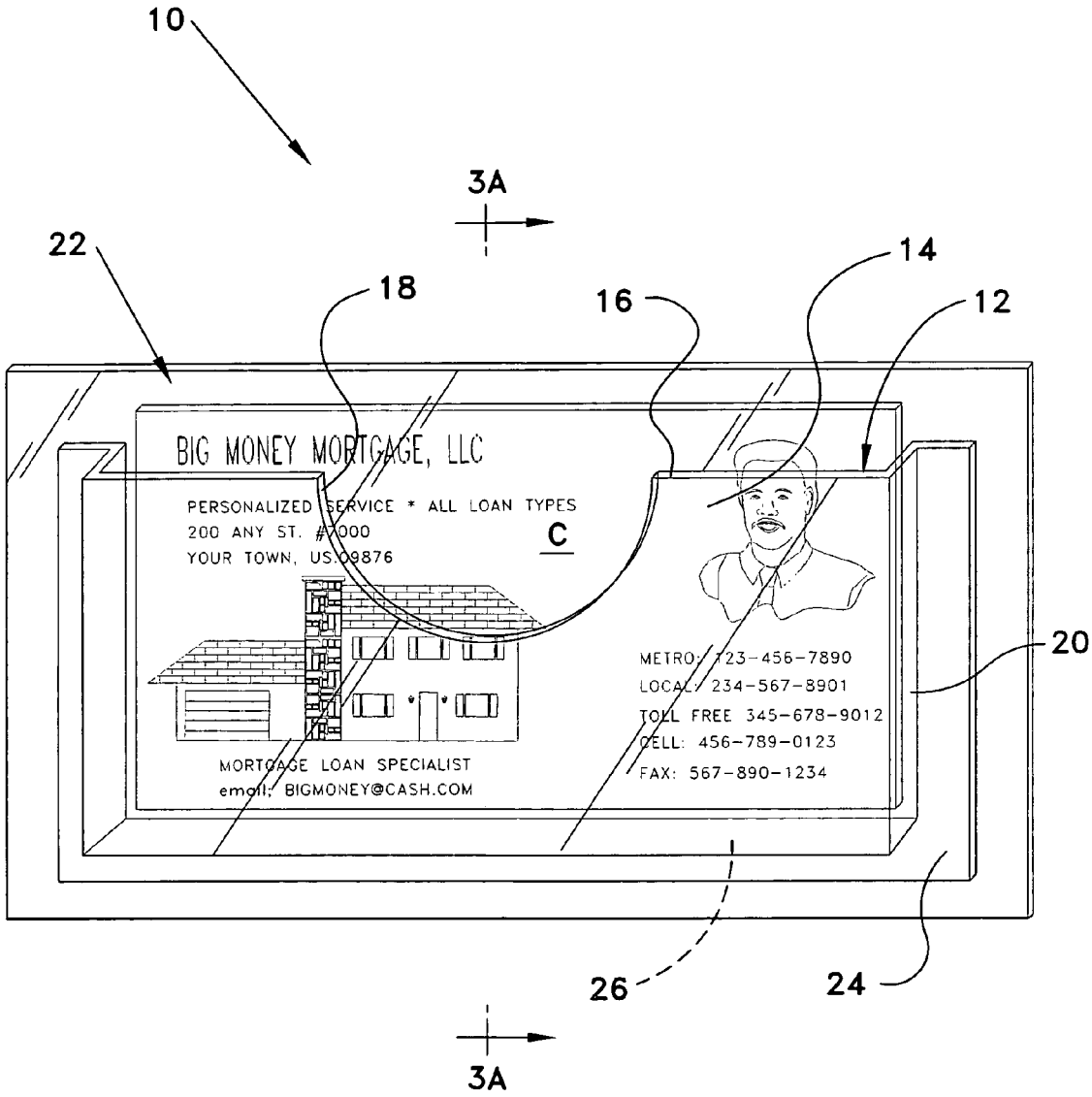
FIG. 2 is an environmental, perspective view of the business card holder of FIG. 1.

Referring more particularly to FIG. 2, the inventive card holder and dispenser 10 has a front portion defining a card pocket 12 having a front wall 14 with an upper rim 16 having a semicircular thumb cutout 18 for easy removal of a single card (see FIG. 1). Card pocket 12 has pocket sidewalls 20, a basewall 26 and an attachment border 24 extending around pocket 12 for attachment to a rear portion formed by backing 22. A business card C is located within pocket 12.

Figure 3A:
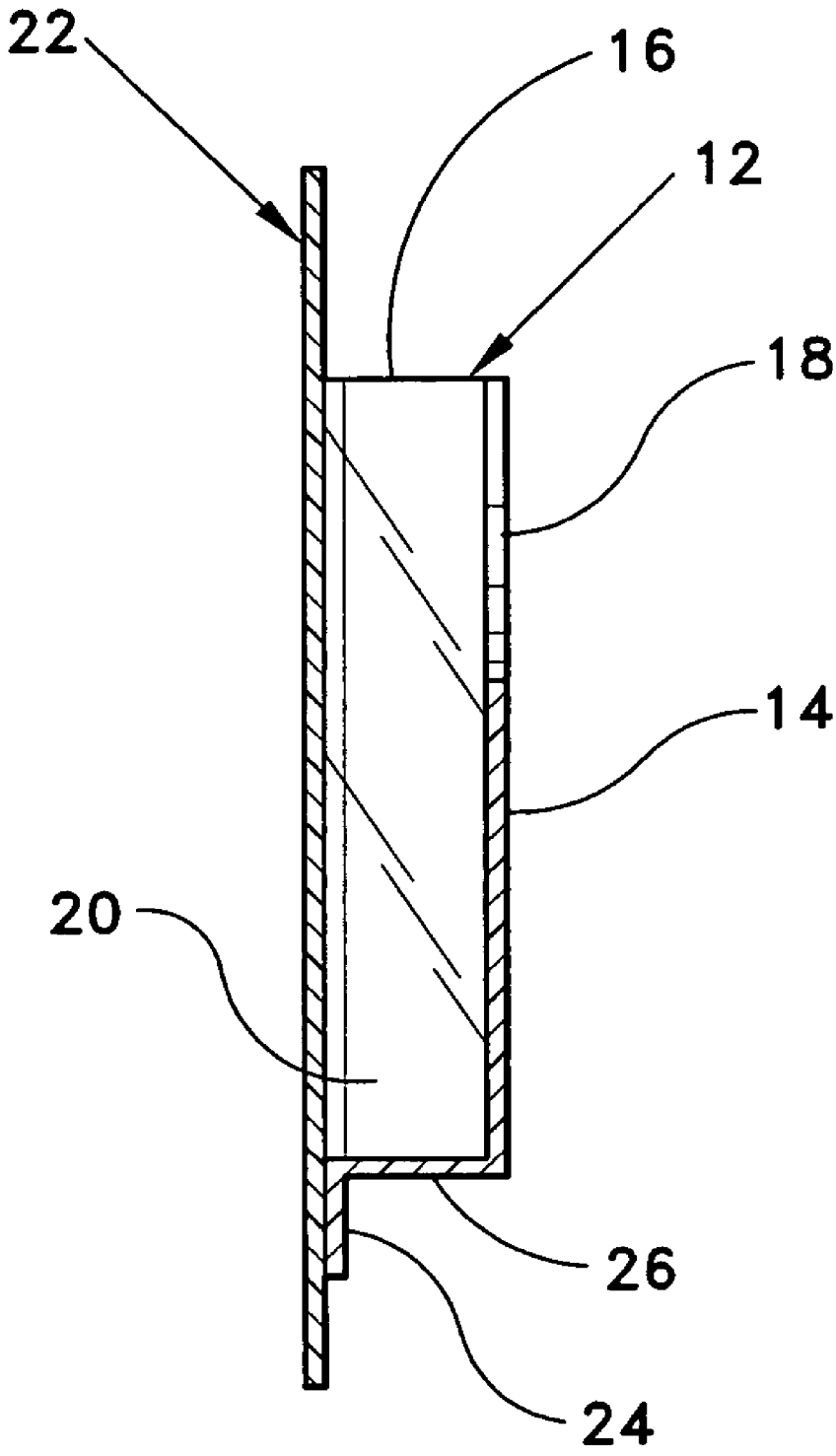
FIG. 3A is sectional view of the business card holder of FIG. 1 taken along the line 3A—3A of FIG. 2.

Referring to FIG. 3A, there is shown a sectional view of the inventive card holder and dispenser 10 having a card pocket 12 with a front wall 14 and an upper rim 16 having thumb cutout 18 and having by sidewalls 20 and basewall 26, pocket 12 being connected to rear backing 22 by attachment border 24. The pocket 12 may be attached at border 24 to backing 22 by any desired means such as heat sealing or adhesive in a known manner.

Figure 3B:
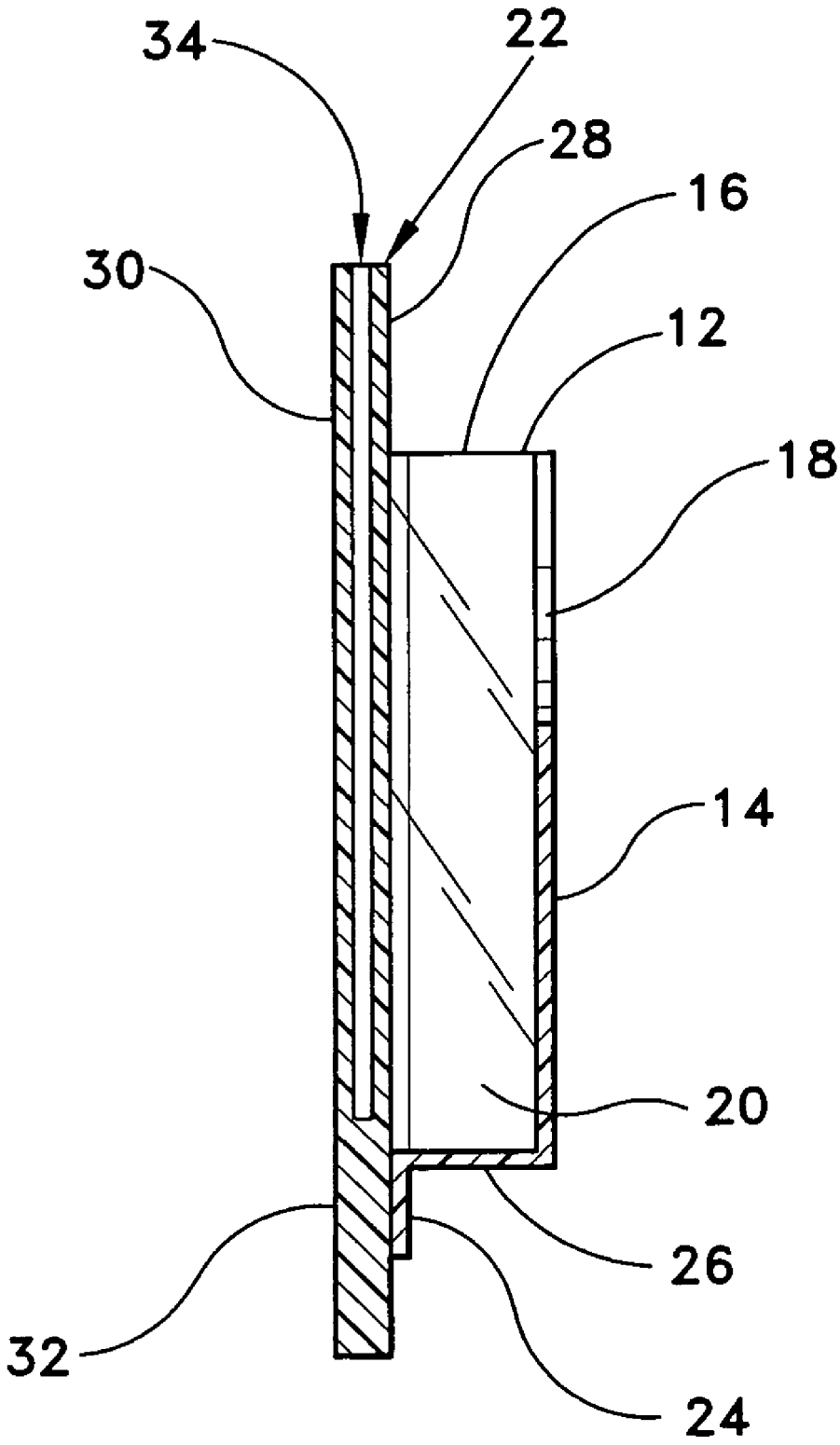
FIG. 3B is sectional view similar to that of FIG. 3A illustrating a double wall backing portion of the business card holder of FIG. 1.

Referring to FIG. 3B, there is shown a double wall backing having a front wall 28 and a rear wall 30 with a lower closure 32 forming a rear single card receiving pocket 34 for holding a card C (not shown) to remain in the card holder and dispenser 10, once the supply of cards in card pocket 12 is exhausted. The rear card pocket 34 may be open at the sides or closed (as shown) and may remain open at the top or sealed shut over the card by adhesive or heat sealing to permanently hold the card in place.

Figure 3C:
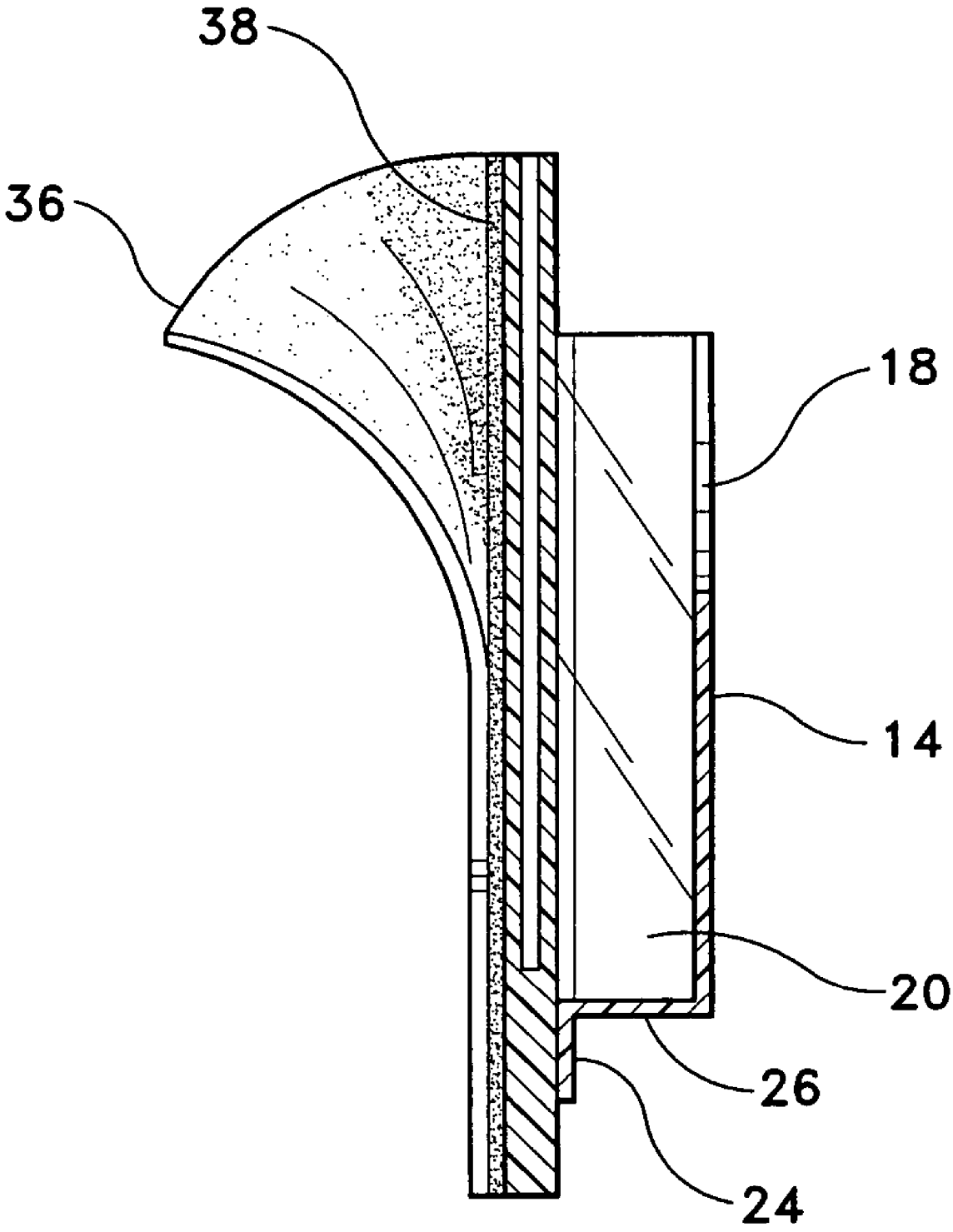
FIG. 3C is a sectional view similar to that of FIG. 3B illustrating a removable backing adhesive layer on the backing portion of the business card holder of FIG. 1.

As further seen in FIG. 3C, rear wall 30 of pocket 34 may have an adhesive layer 38 for adhesion to a brochure or wall, the adhesive layer 38 having a peel off backing 36 to protect the adhesive layer until attachment of the card holder and dispenser 10 is fixed in place on the desired surface.

Figure 3D:
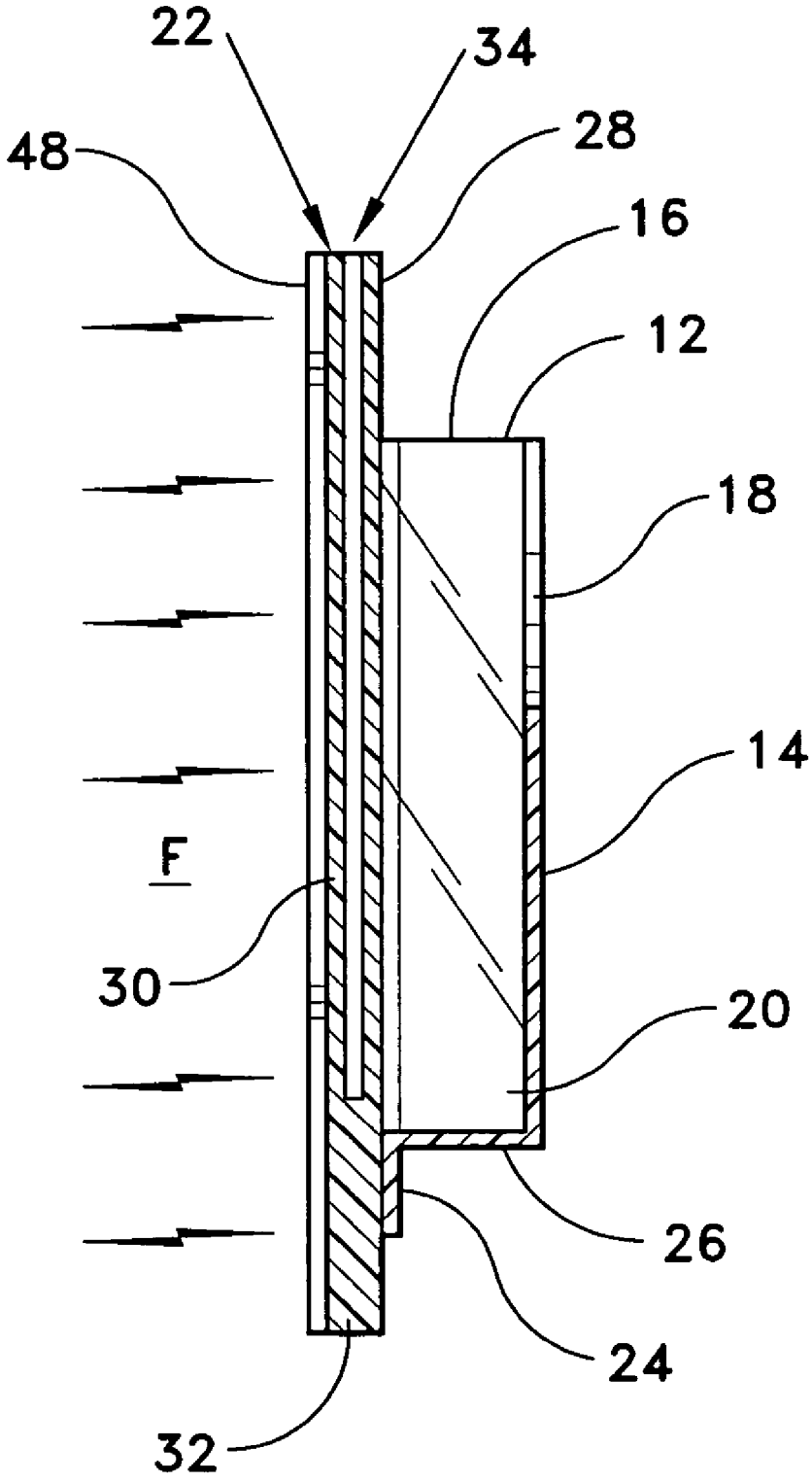
FIG. 3D is a sectional view similar to that of FIG. 3B having a magnetic layer attached to the backing portion of the business card holder of FIG. 1.

As further seen in FIG. 3D, rear wall 30 of pocket 34 may have a layer of magnetic layer 40 for removable attachment of card holder and dispenser 10 to a metal surface through magnetic lines of force F, magnetic layer 40 being attached to rear wall 30 by heat sealing, adhesive, or other appropriate means. Alternatively, a business card made of magnetic material may be employed in rear card pocket 34, emitting magnetic lines of force F for attachment to a metal surface.

Although adhesive 38 with peel off backing 36 is shown with the double wall rear pocket embodiment of FIG. 3B, they may be applied to the single backing 22 of the embodiment of FIG. 3A in a similar manner. Also, the magnetic layer 48 may likewise be directly applied to single backing 22 of the embodiment of FIG. 3A for removable mounting of the business card holder and dispenser 10 of the present invention to a metal surface.

Figure 4:
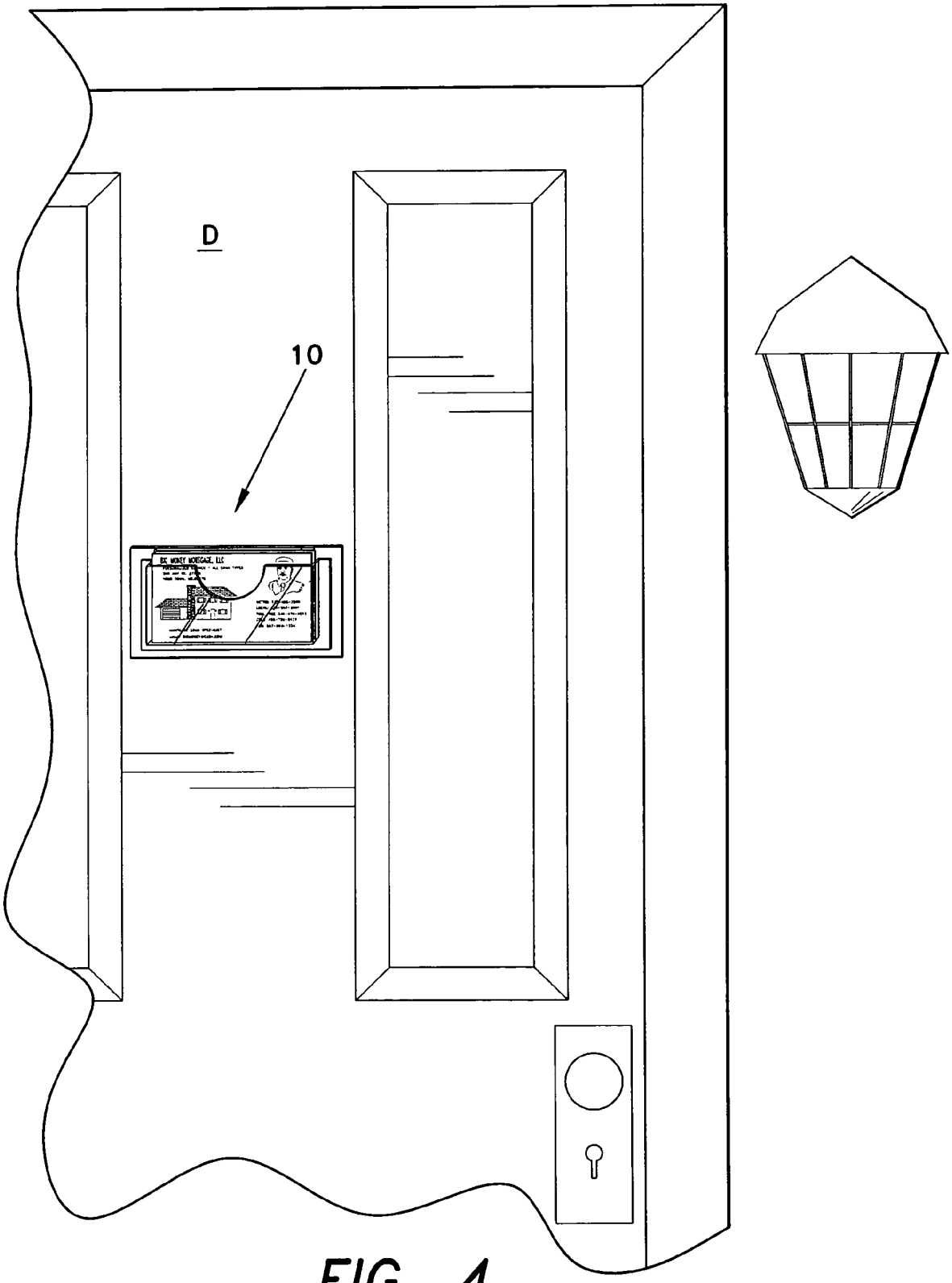
FIG. 4 is an environmental perspective view of the business card holder of FIG. 1 as mounted on a door by adhesive or magnetic means as shown above.

Referring to FIG. 4, there is shown a typical application of the business card holder and dispenser 10 of the present invention to a door D of a business by adhesive or magnetic mountings as discussed above.

Figure 5:
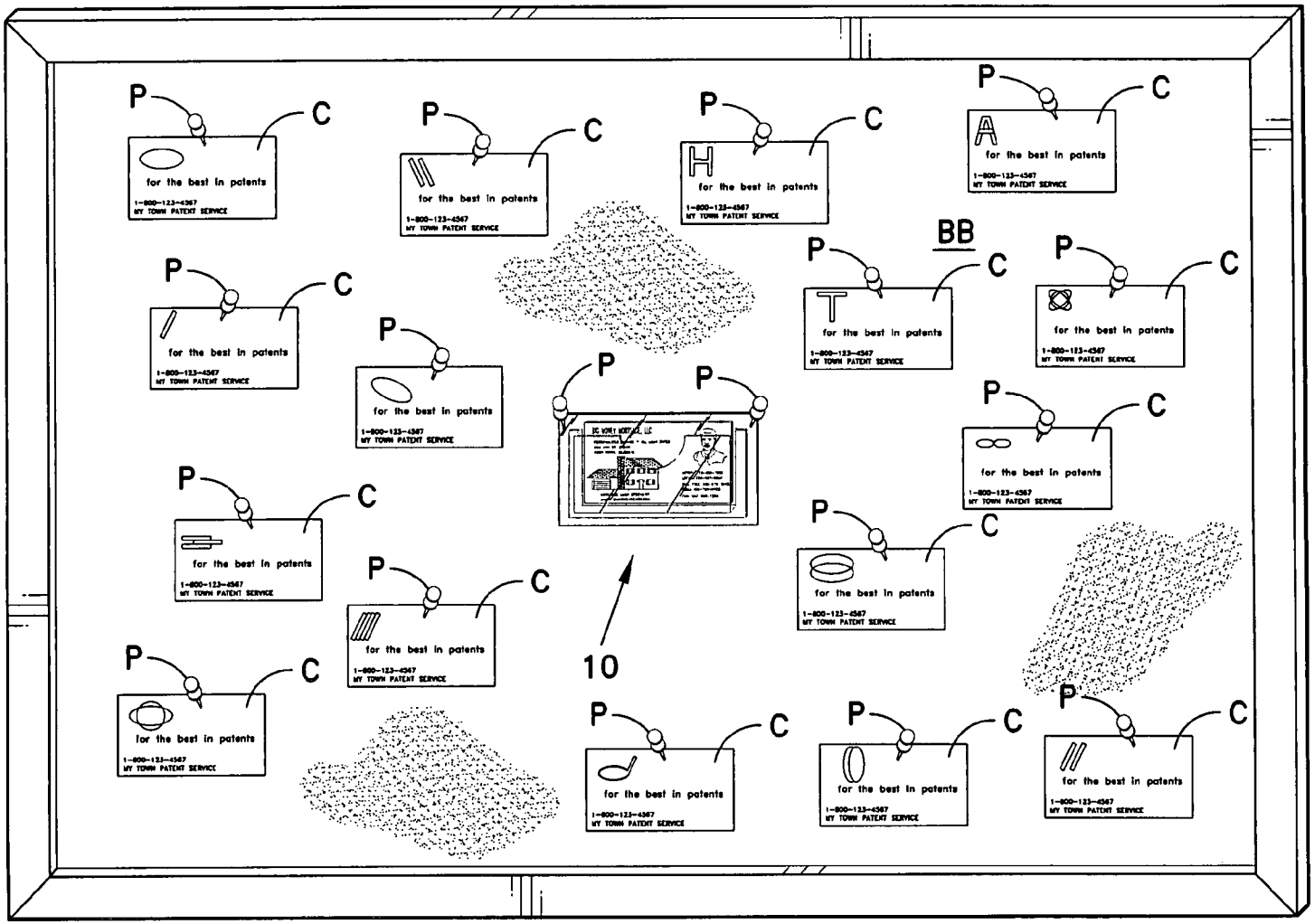
FIG. 5 is an environmental perspective view of the business card holder of FIG. 1 mounted by pins to a community bulletin board commonly used for mounting business cards.

Referring to FIG. 5, there is shown another application of the business card holder and dispenser 10 of the present invention wherein pins P penetrate the backing element 22 (see FIG. 2) at the respective upper sides thereof for pinning holder and dispenser 10 to a bulletin board BB such as a community bulletin board as found in grocery stores, convenience stores, book stores, and waiting areas of service businesses such as car repair and barber shops. The card holder and dispenser 10 is similar in size to other single posted business cards C. The inexpensive construction of the inventive card holder and dispenser allows its repeated posting on such boards even though it may periodically be removed along with other cards by the custodian of the board and destroyed. The bulletin boards may be periodically revisited and replenished with cards where the card holder and dispenser remains on the bulletin board.

In some applications, such as the attachment of the inventive card holder and dispenser to a brochure, the front portion, i.e., the card pocket 12, may be attached directly to a surface such as a brochure B by means of adhesive applied to the attachment border 24 which is then sealed against the brochure surface. This eliminates the need for a backing element 22 or 28, the brochure surface acting as the backing.

The material of which the various embodiments of the business card holder and dispenser of the present invention is preferably of thin or film-like, transparent plastic material and the construction is such that the inventive holder and dispenser is disposable, either by itself or as applied to a disposable brochure or the like. Depending on the application, the inventive business card holder may be mounted by any convenient means such as adhesive, pins, thumbtacks, staples, or magnetic layers.

It is to be understood that the present invention is not limited to the embodiments described above, but encompasses any and all embodiments within the scope of the following claims.

I claim:

1. A disposable business card holder and dispenser comprising:

a pocket having a front wall and opposed side walls, and a basewall, said front wall and said opposing walls defining an upper rim having three sides, an attachment border extending from said side walls and said base wall;

wherein said pocket is attachable to a support surface by said attachment border, and a backing attached to said pocket at said attachment border for attachment to the support surface;

said backing having front and rear walls forming a card pocket, said front and rear walls being spaced substantially the thickness of a business card;

said pocket is configured and dimensioned to hold a plurality of business cards therein.

2. The disposable business card holder and dispenser of claim 1, wherein said pocket and said attachment border are integrally made of transparent plastic.

3. The disposable business card holder and dispenser of claim 2, in combination with a brochure attached thereto.

4. The disposable business card holder and dispenser of claim 1, further comprising a rear-mounted adhesive layer located on said backing.

5. The disposable business card holder and dispenser of claim 1 further comprising a rear-mounted magnetic layer located on said backing.

6. The disposable business card holder and dispenser of claim 5, wherein said card holder is removably attached to a metal surface by means of said magnetic layer.

7. The disposable business card holder and dispenser of claim 1, wherein said front wall has a thumb cutout along its upper rim.

8. A disposable business card holder and dispenser comprising:

a pocket having a front wall and opposed side walls, and a basewall, said front wall and said opposing walls each having an upper edge defining an upper rim having three sides, and said front wall having a cutout substantially centrally disposed along the upper edge, an attachment border extending from said side walls and said base wall, and a backing, said backing being attached to said attachment border, said backing having front and rear walls forming a card pocket, said front and rear walls being spaced substantially the thickness of a business card, wherein said pocket is configured and dimensioned to hold a plurality of business cards therein, whereby said backing is adapted for connection with a display surface.

9. The disposable business card holder and dispenser of claim 8, further comprising a rear-mounted magnetic layer located on said rear backing.

10. The disposable business card holder and dispenser of claim 8, further comprising a rear-mounted adhesive layer located on said backing.

11. The disposable business card holder and dispenser of claim 10, said adhesive layer having a peel-off backing.

* * * * *